US005678326A

United States Patent [19]

Pavelescu

[11] Patent Number: 5,678,326

[45] Date of Patent: Oct. 21, 1997

[54] WATERPROOF LAMINATED SHAPED ELEMENT AND ITS APPLICATION IN SHOES

[75] Inventor: Liviu-Mihai Pavelescu, Dortmund, Germany

[73] Assignee: Akzo Nobel NV, Arnhem, Netherlands

[21] Appl. No.: 627,310

[22] Filed: Apr. 3, 1996

[30] Foreign Application Priority Data

Apr. 8, 1995 [DE] Germany ..... 195 13 413.3

[51] Int. Cl.[6] ..... A43C 13/08; A43B 23/07

[52] U.S. Cl. ..... 36/14; 36/55; 36/12

[58] Field of Search ..... 36/14, 55, 12; 12/142 E, 142 RS, 142 T

[56] References Cited

U.S. PATENT DOCUMENTS

| | | | |
|---|---|---|---|
| 2,329,209 | 9/1943 | Manson et al. | 36/55 X |
| 4,508,582 | 4/1985 | Fink | 156/93 |
| 4,899,465 | 2/1990 | Bleimhofer et al. | 36/14 |
| 5,285,546 | 2/1994 | Haimerl | 36/14 X |
| 5,289,644 | 3/1994 | Driskill et al. | 36/55 X |
| 5,418,044 | 5/1995 | Mahler | 428/196 |

FOREIGN PATENT DOCUMENTS

| | | | |
|---|---|---|---|
| 0 464 800 A2 | 1/1992 | European Pat. Off. | A43B 7/12 |
| 2 106 984 | 9/1971 | Germany . | |
| 3 815 634 | 5/1988 | Germany . | |
| 3 821 602 | 6/1988 | Germany . | |

OTHER PUBLICATIONS

German Search Report dated Aug. 6, 1996.

German Patent Office Action dated Nov. 20, 1995 with translation.

*Primary Examiner*—Ted Kavanaugh

*Attorney, Agent, or Firm*—Joseph M. Noto; Louis A. Morris

[57] ABSTRACT

A waterproof laminated shaped element used as an insert for shoes of a cement-lasted design, including an outer layer, an insole, a lining and a waterproof, water-vapour permeable laminate including a functional layer and optionally a support layer, where a border section of the lower area of the laminate is turned back and bonded to the side having the functional layer such that the lining 3 abuts the edge of the border of the turned-back lower area of the laminate and the border section of the lower area of the laminate is bonded to the insole with a layer of adhesive is disclosed.

7 Claims, 1 Drawing Sheet

WATERPROOF LAMINATED SHAPED ELEMENT AND ITS APPLICATION IN SHOES

CROSS REFERENCE TO RELATED APPLICATIONS

This application claims the benefit of the filing date of prior German Application No. 195 13 413.3 filed on Apr. 8, 1995, which is incorporated herein by reference in its entirety.

BACKGROUND OF THE INVENTION

1. Field of the Invention

The invention relates to a waterproof laminated shaped element used as an insert for shoes of a cement-lasted design, which is formed in the shape of a shoe and includes an outer layer, an insole, a lining and a waterproof, water-vapour permeable laminate including a functional layer and optionally a support layer, and to the application of this element in shoes.

2. Description of the Related Art

It is well known that shoes with an outer layer consisting of materials such as leather or woven fabric and with an inner lining allow water to seep into the inner area of the shoe in wet conditions, for which reason waterproof shoes are required. It is also desirable for an inner layer to be used in the shoe which is waterproof but water-vapour permeable, so that moisture gathering in the inner area of the shoe due to the wearer's foot perspiring can be transported away. In order to solve these problems, shoes are manufactured which have at least one layer on the side of the lining facing away from the inner area of the shoe, known as the functional layer, which comprises polymers on a copolyether ester base, an orientated polytetrafluoroethylene film, a polyester membrane and/or a micro-porous polyurethane layer.

When a functional layer of this kind is used, it is necessary to join it to the insole and the outsole in a manner which guarantees long-lasting waterproofness. It has been found, however, in particular when the waterproof and water-vapour permeable functional layer is sewn to the insole, outsole and/or outer layer, that water outside the shoe is able to seep through the seams into the inner area of the shoe by capillary action. As a solution to this problem it is suggested in DE-OS 38 21 602 that a shaft material be used which is porous in the lower area and which can be penetrated by the liquid synthetic material of a sole when the latter is spray-moulded onto the upper.

In a further embodiment, the shaft material ends at a distance from the lower end of the lining, and the end of the shaft material is joined to a porous spacer which can be penetrated by the liquid synthetic material of the sole when the latter is spray-moulded onto the upper. The spacer and the structure of the lower area of the shaft material allow the liquid synthetic material of the sole to penetrate the pores, but no satisfactory improvement is achieved in protection against water seeping in by capillary action from the area where the upper is joined to the sole, since the high mechanical stress exerted on the shoe as the foot rolls forwards or a step is taken can, over a long period of time, cause the pore wall to tear, or at least cause the bonded synthetic sole material to tear away from the pores of the spacer, whereby the physical strain can only increase on the joints between the synthetic sole material and the spacer which are still intact, possibly also with the unfortunate result that pores are torn into or that the synthetic sole material tears away completely from the pores.

Due to the cracks and tears in the spacer and in the shaft material caused by this tearing or tearing away from the sole material, water which has moved towards the outsole due to saturation of the outer layer can also seep into the area between the spacer and the functional layer of the side part, or the area of the sealing lip of the outsole. This effect is accentuated if, as suggested in this publication, a seam applied by a Strobel machine is located between the porous lower area of the outer layer, the spacer, the functional layer and the lining. The prior art completely overlooks the danger that the transition area between the upper and the sole will be subjected to extreme strain, as is rightly indicated by DE-OS 21 06 984, which emphasizes that the connection between the sole and the shaft is subject to high stress, in particular as a result of the impact-type strain exerted on the outsole with each step taken. The result is that an initial waterproofness of the inner area of the shoe can be achieved with this conventional shoe, but long-term and satisfactory waterproofness can no longer be guaranteed when the shoe is used under normal conditions.

It can also be observed that since the outer layer is often made of leather or a leather-like woven fabric, when the pores are punched in the lower area of the shaft material, fibres remain inside the inner area of the pores and, despite the inner area of the pores being filled with the liquid synthetic material of the sole, the remaining fibres act as ideal bridges, allowing water to seep into the inner area of the shoe, apart from the fact that these fibres at least limit the adhesion of the synthetic sole material.

The laminated shaped element described in DE-OS 38 21 602 is not suitable for shoes with glued-on soles, because the adhesive used to bond the soles in place only partly penetrates the porous areas of the extended outer layer and therefore provides no resistance to water penetrating the shoe.

It is also desirable for a shoe to be manufactured in a way that the production process is kept short by using simple and few production steps, and consequently the manufacturing costs low.

SUMMARY OF THE INVENTION

An aspect of the invention is therefore to eliminate the disadvantages specified above. In particular, the intention is to provide a laminated shaped element which is suitable for the production of waterproof, water-vapour permeable shoes with a glued-on sole.

The solution to these problems is the waterproof laminated shaped element used as an insert for shoes of a cement-lasted design, which is formed in the shape of a shoe and includes an outer layer, an insole, a lining and a waterproof, water-vapour permeable laminate including of a functional layer and optionally a support layer, the insert being characterised as follows: a border section 12 of the lower area of the laminate 2 is turned back and bonded to the side having the functional layer 4, the lining 3 abuts the edge of the border of the turned-back lower area of the laminate 2, and the border section 12 of the lower area of the laminate 2 is bonded to the insole 6 with a layer of adhesive 17.

The invention also relates to a waterproof shoe in which the laminated shaped element of the invention is integrated.

These and other aspects of the present invention will become apparent upon a review of the following detailed description and the claims appended thereto.

DETAILED DESCRIPTION OF PREFERRED EMBODIMENTS

In a conventional shoe, water moves by capillary action through the outer layer, which is made of leather or a leather-like woven fabric, into the lower area between the outer layer and the sole and also along the outer layer itself. In this case, it can be observed that from here the water advances between the underside of the laminate, the lower area of which is parallel with the underside of the outsole, and the upper surface of the outsole, reaching the outer border of the lower area of the laminate. During this process the water is able to enter the inner area of the shoe due to the inadequate bonding between the outer border and the synthetic material of the sole along the outer border. The outer border of the laminate is defined as the edge facing the longitudinal centre axis of the shoe.

When the waterproof laminated shaped element of the invention is integrated in the shoe, the border section 12 of the lower area of the laminate 2 is turned back into the inner area of the shoe and lies flat against the upper surface of the remaining section 9 of the lower area of the laminate 2. Preferably, there should be no lining 3 between the remaining section 9 and the turned-back border section 12. Since there is no lining 3 in this area, the border section 12 can be bonded to the remaining section 9 of the laminate 2 in such a way that the turned-back border section 12 lies flat against the upper surface of the remaining section 9 of the lower area of the laminate 2 or with a layer of adhesive in between. Because the border section 12 is turned back, the support layer 5 is also positioned in the area of the outer border 20 of the laminate 2; this guarantees that the area of the outer border 20 is not a cut surface and therefore remains free of undesirable particles such as thread or fabric remnants. The end of the lining 3, and in its continuation the border section 12, is also bonded to the insole, so that even if water should actually penetrate as far as the outer border 20, this water cannot penetrate into the inner area of the shoe.

For this reason, unlike in shoes in the prior art, an intensive bonding is achieved between the outer border 20 of the laminate 2 and the glued-on outsole 13 or the liquid synthetic material of the sole. The bond is homogenous, in other words free of particles, and is waterproof, since there are no particles present to act as bridges for water.

It can also be observed that since the border section 12 and the remaining section 9 of the lower area of the laminate 2 are preferably bonded using a water-vapour permeable adhesive, any moisture given off from the sole of the wearer's foot diffuses along the laminate 2 towards the side wall of the shoe of the invention and out of the shoe.

In one embodiment, the laminate 2 may be a support layer 5, e.g. a flat textile structure such as a nonwoven, felt, knitted fabric, woven fabric or warp-knitted fabric, which should preferably be coated or impregnated with a waterproof and water-vapour permeable material. As well as one or more support layers 5, the laminate 2 may also include a functional layer 4 such as a membrane made from the waterproof and water-vapour permeable material.

To manufacture the waterproof and water-vapour permeable material, polymers can be used which are suitable for forming a micro-porous polymeric matrix. These include polyolefins, such as polyethylene-propylene copolymers, polyethylene, terephthalates, polycaprolactam, polyvinylidenefluoride, polybutyleneterephthalate, polyester copolymers and polytetrafluoroethylene. The waterproof and water-vapour permeable material may be a coating, impregnation or membrane with polymers on a copolyether ester base (Sympatex), or may be made of orientated polytetrafluoroethylene with a micro-porous polyurethane coating (Gore-tex).

Polymers on a copolyether ester base (Sympatex) have proved to be excellent materials for this purpose due to their properties of high water-vapour permeability and high degree of waterproofness and wear resistance.

Polymers on a copolyether ester base are preferred as the waterproof and water-vapour permeable material. The copolyether esters may consist of a large number of recurring intralinear long-chain and short-chain ester units, which are linked statistically head to tail by ester bonds, where the long-chain ester units correspond to the formula $$-O-G-O-\overset{\overset{\displaystyle O}{\|}}{C}-R-\overset{\overset{\displaystyle O}{\|}}{C}-$$

the short-chain ester units correspond to the formula $$-O-D-O-\overset{\overset{\displaystyle O}{\|}}{C}-R-\overset{\overset{\displaystyle O}{\|}}{C}-$$

where G represents a divalent rest remaining after the terminal hydroxyl groups are removed from at least one long-chain glycol with a mean molecular weight of 600 to 6000 and an atomic carbon-to-oxygen ratio of between 2.0 and 4.3, where at least 20 percent by weight of the long-chain glycol has an atomic carbon-to-oxygen ratio of 2.0 to 2.4 and forms 15 to 50 percent by weight of the copolyether ester, R represents a divalent rest remaining after the removal of carboxyl groups from at least one dicarboxylic acid having a molecular weight of less than 300, and D represents a divalent rest remaining after the removal of the hydroxyl groups from at least one diol having a molecular weight of less than 250, where at least 80 mole percent of the dicarboxylic acid used consists of terephthalic acid or its ester-forming equivalents and at least 80 mole percent of the diol with the low molecular weight consists of 1,4-butanediol or its ester-forming equivalents, the sum of the mole percents of the dicarboxylic acid other than terephthalic acid or its ester-forming equivalents and the diol with a low molecular weight other than 1,4-butanediol or its ester-forming equivalents is no more than 20 percent, and the short-chain ester units form 40–80 percent by weight of the copolyether ester.

Preferably, the polymers can be entirely or partly copolyether esters in which at least 70 mole percent of the dicarboxylic acid used is 2,6-naphthalene dicarboxylic acid or its ester-forming equivalents, and in which at least 70 mole percent of the diol with a low molecular weight used is 1,4-butanediol or its ester-forming equivalents, and the sum of the mole percents of the dicarboxylic acid other than 2,6-naphthalene dicarboxylic acid or its ester-forming equivalents and of the diol with a low molecular weight other than 1,4-butanediol or its ester-forming equivalents is no more than 30 percent, and the ester units with short chains form 35 to 80 percent by weight of the copolyether ester.

Even more preferred are polymers which are copolyether esters consisting of a large number of recurring intralinear long-chain and short-chain ester units, which are linked statistically head to tail by ester bonds, where the long-chain ester units correspond to the formula $$-O-G-O-\overset{\overset{\displaystyle O}{\|}}{C}-R-\overset{\overset{\displaystyle O}{\|}}{C}-$$

and the short-chain ester units correspond to the formula $$-O-D-O-\overset{O}{\overset{\|}{C}}-R-\overset{O}{\overset{\|}{C}}-$$

where G represents a divalent rest remaining after terminal hydroxyl groups are removed from at least one long-chain glycol with a mean molecular weight of 600 to 4000 and an atomic carbon-to-oxygen ratio of between 2 and 4.3, where at least 20 percent by weight of the long-chain glycol has an atomic carbon-to-oxygen ratio of 2.0 to 2.4 and forms 15 to 50 percent by weight of the copolyether ester, R represents a divalent rest remaining after the removal of carboxyl groups from at least one dicarboxylic acid with a molecular weight of less than 300, and D represents a divalent rest remaining after the removal of hydroxyl groups from at least one diol having a molecular weight of less than 250, where at least 70 mole percent of the dicarboxylic acid used consists of 2,6-naphthalene dicarboxylic acid or its ester-forming equivalents and at least 70 mole percent of the diol with the low molecular weight consists of 1,4-butanediol or its ester-forming equivalents, and the sum of the mole percents of the dicarboxylic acid other than 2,6-naphthalene dicarboxylic acid or its ester-forming equivalents and the diol with a low molecular weight other than 1,4-butanediol or its ester-forming equivalents is no more than 30 percent, and the short-chain ester units make up 35–80 percent by weight of the copolyether ester.

The copolyether-ester polymer membranes used in a further embodiment can be 10 or 15 μm thick and are distinguished by their high permeability to water vapour of more than 2700 g/m$^2$ (in 24 hours, according to ASTM E 96 66, method B, modified).

The support layer 5 may be bonded, at least in places, to the functional layer 4 and/or a further support layer 5 coated or impregnated with the material specified above, e.g., in spots, lines or a grid pattern and preferably using a water-permeable adhesive. Hydrophilic adhesives are of advantage for this purpose, since they do not hinder the movement of water vapour, such as hydrophilic foamed adhesives on a polyurethane or acrylate base. It is also found extremely advantageous to hot bond the border section 12 to the remaining section 9 of the lower area of the laminate 2.

In order to ensure that the waterproof laminated shaped element fits exactly, the lower area 7 of the outer layer 1 may be positioned parallel with the underside of the outsole 13. The outer layer 1 may be bonded at least in its lower area, i.e., the area of the sealing lip, and in the lower area 7 to the laminate 2 with a layer of adhesive 8.

Where the laminated shaped element of the invention is used in shoes, the lower area of the laminate 2 is positioned parallel to the underside of the outsole 13 and the border section 12 of the lower area of the laminate 2 is turned back towards the inner area of the shoe and bonded with an adhesive to the upper surface facing the inner area of the shoe of the remaining section 9 of the lower area of the laminate 2, preferably by a hot-bonding or cement-lasting method, such that the turned-back border section 12 lies essentially flat against the upper surface of the remaining section 9 of the lower area of the laminate.

Preferably, the border section 12 of the lower area of the laminate 2 should be turned back towards the side having the functional layer 4, so that the support layer 5 faces outwards. This design variant is particularly suitable, since the outer border 20 of the laminate 2 provides an excellent base to which the outsole 13 and the insole 6 can glued or joined, since this surface is free of the thread or fabric remnants otherwise found in the bonding areas of conventional shoes and adversely affecting adhesion.

It is advantageous if the lower area 7 of the outer layer 1 is parallel with the underside of the outsole 13, and the border section 12 of the turned-back lower area of the laminate 2 can extend beyond the edge of the lower area 7 of the outer layer 1 parallel with the underside of the outsole 13. It is also possible for the edge of the lower area 7 of the outer layer 1 to extend beyond the outer border 20 of the laminate 2.

In addition, the upper with the previously constructed waterproof laminated shaped element of the invention can be pulled over the last, the upper being characterised as follows: the remaining section 9 of the turned-back lower area of the laminate 2 is bonded to the border section 12, and an insole is bonded to the turned-back end area of the lining 3 parallel with the underside of the outsole and to the border section 12 of the laminate 2. It is advantageous here to spray-mould the liquid synthetic material of the sole onto the upper under high pressure, without applying a separating layer to the last. The walking support and lateral stability achieved by joining the outer layer 1, the laminate 2 and the outsole 13 tightly together give the shoe of the invention static balance, since an excellent forward rolling movement of the foot is guaranteed and, unlike the prior art, non-porous shaft materials are used without affecting their inner structure, so that a high degree of stability is provided, especially when sudden and impact-type stress is exerted on the outsole 13.

In one preferred embodiment, the outer layer 1 is covered in the lower area of its outer side by the material of the outsole 13, in the form of a spray-moulded sealing lip. In this method, it can also be helpful to treat the surfaces of the side of the outer layer 1 facing away from the inner area of the shoe, i.e., on the outside of the upper, at least in the area which is covered when the synthetic material of the sole is spray-moulded onto the shaft or when the synthetic sole 13 is bonded in place. Mechanical or chemical buffing of the leather or textile layer used as the outer layer 1 not only improves the bonding or adhesion of the outer layer 1 to the sole 13, it also increases the waterproofness of the bond between the outer layer 1 and the sole 13, since the number of flawed areas which remain unbonded is reduced. Leather or textile layers attached to the outer layer 1 or positioned between the outer layer 1 and the laminate 2 can also contribute to increasing the stability of the shoe of the invention.

It has been found in all embodiments of the shoe of the invention that their lateral stability, together with the improved adhesion of the outsole 13, which is bonded or spray-moulded onto the sides, and, for example, the addition of heel caps, is adequate, with the result that the shoe of the invention can be of assistance in providing support against the bending of the heel bone to one side which is symptomatic of pes valgoplanus, resulting from the inner longitudinal arch dropping, and also against the accompanying slipping of the heel bone when stepping down, either toward the outside or the inside, depending on the deformity.

The lining 3 may be made of either: terry; goatskin, sheepskin, cowhide or pigskin; velvet; camel-hair fabric; knitted or woven fleece; or woven fabric, ideally of cotton, new wool, synthetic fibres and/or regenerated and/or modified cellulose.

The outer layer 1 may represent at least one of the group which includes a leather layer, a textile layer, a textile-like layer or a woven fabric. The outer layer may be canvas, fabric, chintz, everglaze, terry, velvet, Manchester velvet, corduroy, velveteen, Norzon, leatherette, moleskin, duvetine, knitted or woven fabric, satin, fur, imitation fur, suede leather, satin-finished leather, patent leather or polished, embossed, shrunk or grained leather.

Waterproof materials such as rubber, polyurethane, polyvinyl chloride and their derivatives, and mixtures of the same, are suitable materials for the synthetic sole.

BRIEF DESCRIPTION OF THE DRAWINGS

The invention shall now be described in greater detail in the following embodiment example. The illustrations are as follows.

Figure 1:
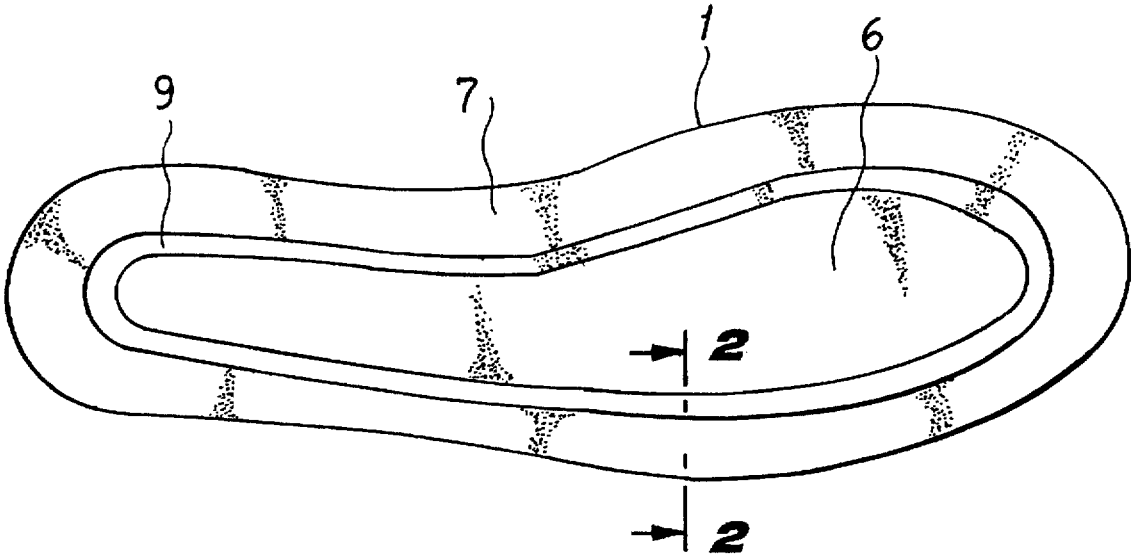
FIG. 1 shows the shoe of the invention from below.
Figure 2:
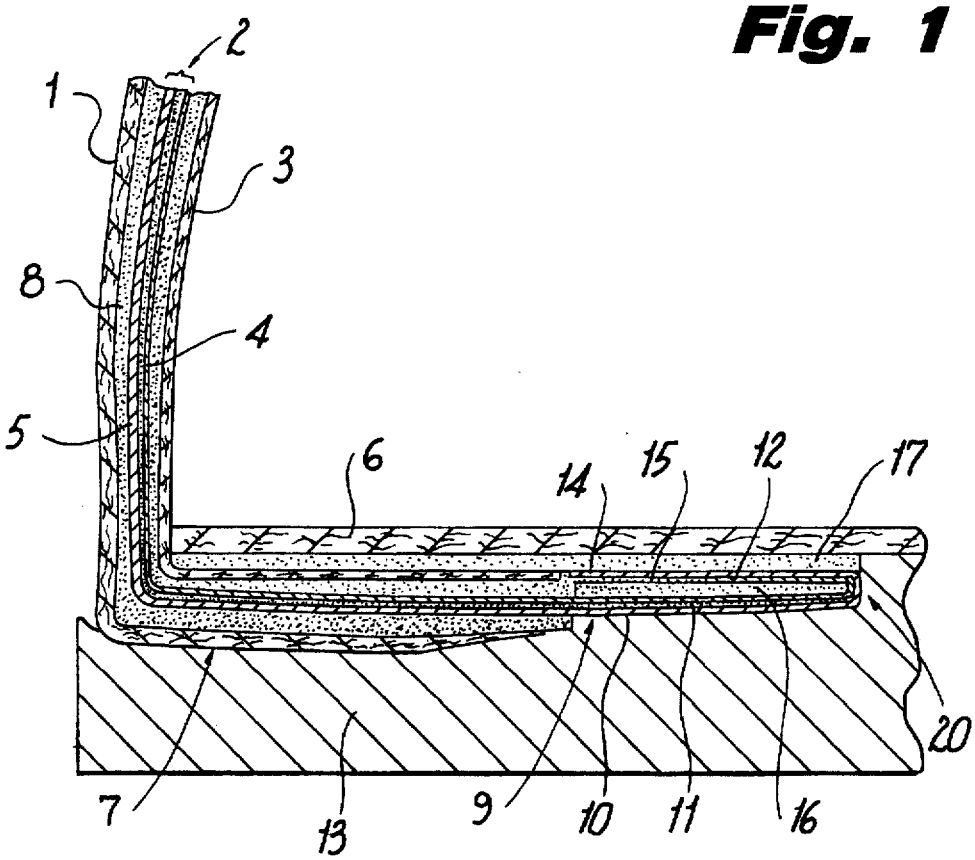
FIG. 2 shows the cross-section A—A of FIG. 1 in the toe area of the shoe of the invention.

Due to the diagrammatic nature of the drawings, the illustration is greatly simplified, enlarged and not drawn to scale. The shoe of the invention has an outer layer 1 of cowhide. The lower area 7 of the outer layer 1 is parallel with the underside of the outsole 13. The end area of the outer layer 1 is bonded to the laminate 2 with a layer of adhesive 8. The edge of the outer layer 1 is tapered off. A 10 μm thick membrane 4 of waterproof, water-vapour permeable material (such as Sympatex) is used as the laminated shaped element. The support fabric 5 is a coarsely woven polyester fabric. The lower area of the laminate 2 is parallel with the underside of the outsole 13, which is made from polyurethane, and the border section 14 of the lower area of the support layer 5 and the border section 15 of the membrane 4 are turned back together toward the inner area of the shoe and lie flat against the upper surface of the remaining section 11 of the membrane 4. The adhesive used between the remaining section 15 and the remaining section 11 is a polyurethane adhesive which is activated with a high-frequency heating device. An insole 6 made of leather is bonded to the turned-back lower area of the lining 3 and to the border section 14 with a layer of adhesive 17. In this preferred embodiment the lining 3 is arranged with its lower area parallel with the underside of the outsole 13.

By spraying polyurethane liquid synthetic sole material 5 at onto the last covered with the upper and the laminated shaped element, an intensive bond is created between the support layer 5, the insole 6 and the synthetic material of the sole. The transition area between the upper surface of the turned-back outer border 20 of the lower area of the laminate 2 and the upper surface of the outsole is smooth, with no undesirable bumps, ridges or indentations which could cause pressure points on the sole of the wearer's foot. The transition area is smooth and forms a continuous surface since the outsole is sprayed onto the upper under pressure.

In a further embodiment, the lower area of the lining 3 can be arranged essentially perpendicular to the outsole 13, so that the border section 12 of the lower area of the laminate 2 abuts the surface of the lining 3 facing the inner area of the shoe. Preferably the edge of the border section 12 facing the shoe upper is arranged essentially in the direction of the upper area of the laminate 2. The upper area of the laminate 2, the outer layer 1 and the lining 3 form the foot-insertion opening of the waterproof shoe of the invention. As a result, additional lateral support is provided for the foot at the sides of the footbed of the shoe of the invention.

Thorough tests have found the inner area of the shoe of the invention to be sufficiently watertight, despite the relatively simple production methods employed, which do not require any complicated or precise alignment of the shoe components. This characteristic is due to the fact that the side or outer border 20 of the support layer 5 facing the outsole 13 guarantees a durable, thorough and waterproof bond when the synthetic material of the sole is either bonded or spray-moulded into place, since there are no particles to adversely affect adhesion. It has also been found that the wearing comfort, in particular the rolling movement in the shoe of the invention, is in no way impaired by the border section 12 of the lower area of the laminate 2 being turned back towards the inner area of the shoe and bonded to the remaining section 9 of the lower area of the laminate 2; quite to the contrary, this shoe actually solves the problems of limited flexibility, insufficient rolling movement, high production costs and time-consuming production, in a balanced manner and when least expected by one skilled in the art. Also, spraying the liquid synthetic material of the sole under pressure produces, simply and economically, a footbed which is essentially contoured to the foot of the user and therefore increases the wearing comfort of the shoe.

While the invention has been described with preferred embodiments, it is to be understood that variations and modifications are to be considered within the purview and the scope of the claims appended hereto.

What is claimed is:

1. A waterproof laminated shaped element used as an insert for shoes of a cement-lasted design, which is formed in the shape of a shoe and comprises an outer layer, an insole, a lining and a waterproof, water-vapour permeable laminate comprising a functional layer, wherein a border section of the lower area of the laminate is turned back and bonded to the side having the functional layer, the lining abuts the edge of the border of the turned-back lower area of the laminate, and the border section of the lower area of the laminate is bonded to the insole with a layer of adhesive.

2. A waterproof shoe comprising a waterproof laminated shaped element in accordance with claim 1.

3. The waterproof shoe in accordance with claim 2, wherein a lower area of the outer layer is parallel with an underside of an outsole.

4. The waterproof shoe in accordance with claim 3, wherein the lower area of the outer layer is at least partially bonded to the laminate with a layer of adhesive.

5. The waterproof shoe in accordance with claim 4, wherein the outsole is bonded to the insole, the remaining section of the laminate and the lower area of the outer layer.

6. The waterproof shoe in accordance with claim 4, wherein a sole material is spray-moulded onto the insole, the remaining section of the laminate and the lower area of the outer layer.

7. The waterproof laminated shaped element of claim 1, wherein said element includes a support layer.

* * * * *